United States Patent [19]

Gravely et al.

[11] Patent Number: 4,556,073

[45] Date of Patent: Dec. 3, 1985

[54] PROCESS FOR REDUCTION OF NITRATE CONTENT OF TOBACCO BY MICROBIAL TREATMENT

[75] Inventors: Lawrence E. Gravely, Louisville, Ky.; Vernon L. Geiss, Georgetown, Ind.; Charles F. Gregory, Middletown, Ky.

[73] Assignee: Brown & Williamson Tobacco Corporation, Louisville, Ky.

[21] Appl. No.: 916,323

[22] Filed: Jun. 15, 1978

[51] Int. Cl.[4] ..... A24B 3/14; A24B 15/02

[52] U.S. Cl. ..... 131/297; 131/308; 131/356; 131/370; 435/267

[58] Field of Search ..... 131/143, 140 B, 141, 131/142, 140 C, 308, 297, 356, 370–375; 210/601, 603, 605; 435/172, 262, 267

[56] References Cited

U.S. PATENT DOCUMENTS

| | | | |
|---|---|---|---|
| 3,829,377 | 8/1974 | Hashimoato | 210/143 |
| 3,847,164 | 11/1974 | Mattina | 131/143 |
| 4,131,118 | 12/1978 | Gellatly | 131/143 |

*Primary Examiner*—V. Millin
*Assistant Examiner*—Gregory Beaucage
*Attorney, Agent, or Firm*—Charles G. Lamb

[57] ABSTRACT

A process for the reduction of the nitrate content of tobacco materials by microbial treatment is disclosed wherein tobacco materials are subjected, under controlled conditions, to the action of a microorganism effective to degrade nitrates through a biochemical reaction. Tobacco materials treated in accordance with this process, when incorporated into a tobacco smoking product, produce a mild smoke having reduced nitrogen oxides and hydrogen cyanide deliveries without loss of desirable flavor, taste or other smoking properties.

22 Claims, No Drawings

PROCESS FOR REDUCTION OF NITRATE CONTENT OF TOBACCO BY MICROBIAL TREATMENT

BACKGROUND OF THE INVENTION (A) Field of the Invention

The present invention relates to a process for reducing the nitrate content of tobacco materials by treating the tobacco with cultures of microorganisms. More specifically, the invention relates to a process for treating tobacco materials to reduce the nitrate content thereof, which, when incorporated into a tobacco smoking product, yield smoke with reduced nitrogen oxides and hydrogen cyanide deliveries without loss of desirable flavor and taste properties or other smoking qualities.

(B) Prior Art

For various reasons, it is often desirable to reduce the nitrate content of tobacco. For example, in recent years, low delivery cigarettes have gained substantial consumer acceptance and numerous techniques have become available for reducing smoke deliveries.

In the removal or reduction of the nitrate content, the most common methods have included the use of chemical agents in selective nitrate and ion removal from tobacco extracts by ion retardation (U.S. Pat. No. 3,847,164) and ion exchange (U.S. Pat. No. 3,616,801) techniques. However, there is no treatment known which enables reduction of the nitrate content of tobacco which includes the use of microorganisms.

SUMMARY OF THE INVENTION

It is an object of the present invention to provide a process for reducing the nitrate content of tobacco. It is another object of this invention to provide a process for the preparation of an aqueous medium containing a microorganism which may be used for the degradation of the nitrate content of tobacco. Other objects and advantages of this invention will become apparent to those skilled in the art upon consideration of the accompanying disclosure.

The present invention resides in the recognition that certain microorganisms in an aqueous solution, when coming in contact with tobacco, degrade the nitrate content of the tobacco. It has been found that tobacco material treated with a pure culture of specific microorganisms degrade nitrates in tobacco materials. In so doing, a tobacco material is produced that, when placed in a blended cigarette, contributes to decreasing deliveries of nitrogen oxides and hydrogen cyanide. A preferred culture includes *Micrococcus denitrificans*, (*Paracoccus denitrificans* Am. Type Culture Collection Accession No. 17741) as described in *Bergeys Manual of Determinative Bacteriology*, Edited by R. E. Buchanan and N. E. Gibbons, pp. 438–439, 8th Edition. However, it is realized that other cultures may also be used, such as: *Micrococcus halodenitrificans, Alcaligenes faecalis, Bacillus licheniformis, Bacillus stearothermophilus, Erwinia carotovora, Pseudomonas aeruginosa, Pseudomonas chlororaphis, Pseudomonas fluorescens, Pseudomonas stutzeri, Thiobacillus denitrificans.* Also, nitrate-containing compounds may also be used in combination with the microorganisms, such as, potassium nitrate, sodium nitrate, ammonium nitrate, and the like.

Using the culture of the present invention, it is practical to treat burley or flue-cured lamina or stem and remove the nitrates therein or to make a water extract of either material and remove the nitrates and then reapply the treated extract to the original tobacco materials. The capability of treating the extract and then reapplying it to the original tobacco avoids the solubles weight loss encountered when using water extraction and discard as a vehicle for removing nitrate. It also avoids the loss of other desirable tobacco components encountered in water extraction and discard. This process is also useable in reconstituted tobacco production systems wherein the tobacco is extracted and the extract is added back in subsequent process steps, since this enzyme (microbial) system functions efficiently in a liquid system. In the process, the nitrate is broken down and converted to gaseous nitrogen, which is released to the atmosphere.

It has been found that the nitrate-containing compound in the aqueous medium must be at least 0.1 percent by weight in the medium and preferably in the range of about 1 percent. Even though higher percentages of nitrate-containing compounds may be used, increasing the nitrate-containing compound in excess of 1 percent by weight does not appreciably assist in the degrading capabilities of the microorganisms.

DESCRIPTION OF THE PREFERRED EMBODIMENTS

According to the present invention, one preferred method for reducing the nitrate content of tobacco is to prepare an aqueous medium containing microorganisms which will degrade nitrates.

In the preparation of an aqueous medium, a nutrient agar (first) solution is prepared by adding a commercially available nutrient agar to distilled water, the amount of agar generally being at least 5 grams per liter. In one proposed method, to this is added a nitrate-containing compound, preferably potassium nitrate, which is at least 0.1 percent by weight of nitrate per volume of water and is generally about 1 percent by weight of nitrate per volume of water.

This solution is then sterilized as tubed slants; that is, test tubes containing the nutrient agar solution are placed at a slant to provide a slanted surface in an autoclave for at least 15 minutes at at least 15 psig and at 121° C. The sterilized medium is then placed in a refrigerator for later use.

A second solution is prepared which includes a nitrate-containing substance therein which is to be treated by the culture grown in the first medium. One such second solution may be a nutrient broth containing nitrates therein which is prepared by dissolving a commercially available nutrient broth in distilled water, the amount of nutrient broth being from about 5 to 10 grams per liter. However, it is realized that those skilled in the art may vary the nutrient broth concentration and achieve a useable culture. This solution is also sterilized for at least 15 minutes at at least 15 psig and 121° C. or greater in an autoclave. Potassium nitrate or other nitrate-containing compounds may be added to this solution prior to the sterilization.

Another example of a second solution may be a tobacco extract broth containing nitrates. The tobacco extract broth is prepared by taking usually about 100 grams of tobacco material, such as, a flue-cured burley stem mixture and mixing this with about 1,000 milliliters of water and then cooking the mixture in an autoclave for about 30 to 60 minutes at at least 15 psig and 121° C. or greater.

The resultant liquid extract is then removed and the liquid volume is adjusted to the original amount of the extract by adding distilled water. The extract is then mixed with yeast extract, the yeast extract being generally at least 0.3 percent by weight to volume of liquid. However, greater amounts of yeast extract may be used if desired. The mixture is dispensed into flasks that are cotton-plugged and sterilized for at least 15 minutes at 15 psig or greater and 121° C. or greater for subsequent culture propagation. Prior to use for culture growth, the pH is adjusted with appropriate acid or base to about 7.2. The microorganism, preferably *Micrococcus denitrificans,* is incubated on the nutrient agar slants for from three to five days at 5° to 37° C. The resultant growth is then used to inoculate the pH adjusted tobacco extract broth, the inoculum being removed from the slants by washing the slant surface with a predetermined amount of distilled water. The inoculated tobacco extract broth is then subjected to agitation for generally about 24 hours at 5° to 37° C. to promote growth of the culture.

The resultant inoculum is then ready for use in the treatment of tobacco materials to reduce the nitrate content therein.

In the treatment of tobacco materials (solids), the pH of the tobacco is adjusted with a base and water mixture to about 7.0 to 7.2. The culture is then applied along with additional water and the tobacco so treated is usually placed in plastic bags where nitrate degradation occurs.

A more comprehensive understanding of the invention can be obtained by considering the following examples. However, it should be understood that the examples are not intended to be unduly limitative of the invention.

EXAMPLE 1

The following example demonstrates the procedure that was followed in the preparation of inoculum.

(a) Nutrient agar+1.0% potassium nitrate.

Commercially prepared Nutrient Agar (dehydrated form) from Difco Laboratories was added to distilled water in the ratio of 23 grams per liter. The 23 grams of Nutrient Agar contained 3 grams of beef extract; 5 grams of peptone and 15 grams of agar. To this solution was added 1% of potassium nitrate by weight to volume of water. The resulting solution had a final pH of 6.8.

This medium was then sterilized as tubed slants in an autoclave for 15 minutes at 15 psig and 121° C., cooled, and refrigerated for later use to grow cultures.

(b) Nutrient Broth.

A solution of Nutrient Broth media was prepared by adding dehydrated Nutrient Broth from Difco Laboratories at a rate of 8 grams per liter to distilled water. The Nutrient Broth contained 5 grams of peptone and 3 grams of beef extract. The resulting aqueous medium was then sterilized for 15 minutes at 15 psig and 121° C. for later use in culture growth.

(c) Flue-Cured/Burley Stem Tobacco Extract Broth.

A flue-cured/burley stem tobacco extract broth was prepared by adding 100 grams of flue-cured/burley stem to 1,000 ml of water and cooking in an autoclave for 40 minutes at 15 psig and 121° C. The resultant liquor extract was removed and the liquid volume was adjusted to its original amount with distilled water. The liquor was then mixed with yeast extract (YE) at a rate of 0.5% by weight of yeast extract per volume of liquor and the mixture dispensed into flasks that were cotton-plugged and sterilized at 15 psig for 15 minutes at 121° C. for subsequent culture propagation.

(d) Broth Inoculation.

The microorganism, *Micrococcus denitrificans* (American Type Culture Collection Accession Number 17741), is incubated on the Nutrient Agar slants for from three to five days at 30° C. Liquid media, for example, Nutrient Broth or flue-cured/burley stem tobacco extract broth are inoculated at a 2% (v/v) rate with a sterile water wash of culture from slants. The pH of the broth prior to inoculation is adjusted with hydrochloric acid or sodium hydroxide to about 7.2 to b 7.5. The flasks are then subjected to rotary agitation for approximately 24 hours at 30° C. and 160 rpm.

EXAMPLE 2

This example demonstrates the nitrate degradation that occurs in flue-cured/burley stem extract and flue-cured stem extract.

*Micrococcus denitrificans* (Am. Type Culture Collection Accession Number 17741) was grown in flue-cured/burley stem extract (+0.5% YE) prepared as described in Example 1 and in flue-cured stem extract prepared as follows:

Fifteen pounds of flue-cured stem was extracted in 240 pounds of water at 90° C. for 30 minutes. The extract was centrifugally separated, collected and yeast extract added at a 0.5% (wt/v) rate. The mixture was sterilized for 15 minutes at 15 psig and 121° C.

Both media were inoculated, after pH adjustment, with washings from 4 day slants, at 10% (v/v) rate and incubated at 160 rpm (rotary) and 30° C. for 24 hours in Erlenmeyer flasks (250 ml/500 ml flask).

Results are shown in the following table:

| Medium | Growth Time (hrs) | pH | $NO_3$ (μg/ml) |
|---|---|---|---|
| Flue-cured/Burley Stem | 0 | ~7.50 | 2,500 |
| Extract + 0.5% Yeast Extract | 16 | 8.10 | 59 |
| | 20 | 8.29 | 57 |
| | 24 | — | 55 |
| Flue-cured Stem Extract + 0 | ~7.50 | 716 | |
| 0.5% Yeast Extract | 16 | — | 699 |
| | 24 | 7.96 | 66 |

It can be seen from the above data that the nitrate is substantially degraded in both extracts.

EXAMPLE 3

This example demonstrates the effects of aeration on the culture mass during nitrate degradation using the microorganism *Micrococcus denitrificans.*

A culture of *Micrococcus denitrificans* (ATCC 17741) was grown on Nutrient Agar+1% $KNO_3$ slants and then grown in flue-cured/burley stem extract broth+0.5% yeast extract in shake flasks as described in Example 1.

This culture was split into two equal parts and used as inoculum for two separate fermentors of the same broth+0.5% yeast extract.

Growth parameters for the culture in each fermentor were:

| Parameters | Fermentor A | Fermentor B |
|---|---|---|
| Medium | Flue-cured/burley stem extract + | Flue-cured/burley stem extract + |

-continued

| Parameters | Fermentor A | Fermentor B |
|---|---|---|
| | 0.5% YE | 0.5% YE |
| Volume (liters) | 8 | 8 |
| Agitation (rpm) | 300 | 300 |
| Aeration (cc/min.) | 2,000 | 0 (none) |
| Temp. (°C.) | 30 | 30 |
| pH Set/Control | 7.8 | 7.8 |
| Inoculum Rate (% v/v) (From Flasks) | 5 | 5 |
| Control Acid (2N) | HCL | HCL |
| Control Base (2N) | NaOH | NaOH |

The results of growth under these conditions are shown below.

| Time of Sample | Fermentor A (Aerated) Cells (× $10^6$/ml) | pH | $NO_3$ (μg/ml) | Fermentor B (Unaerated) Cells (× $10^6$/ml) | pH | $NO_3$ (μg/ml) |
|---|---|---|---|---|---|---|
| Before Inoc.* | 0 | 6.78 | 2,630 | 0 | 6.99 | 2,900 |
| Inoculum | 9,500 | 8.10 | 0 | 9,500 | 8.10 | 0 |
| 0 hrs. after Inoc. | 370 | 7.91 | 2,690 | 90 | 7.84 | 2,590 |
| 16 hrs. after Inoc. | 7100 | 7.82 | 560 | 4,500 | 7.85 | 350 |
| 17 hrs. after Inoc. | — | 7.83 | 0 | — | 7.92 | 34 |
| 18 hrs. after Inoc. | 8,600 | 7.82 | 0 | 3,700 | 7.95 | 34 |
| 19 hrs. after Inoc. | — | 7.81 | 0 | — | 7.95 | 34 |
| 21 hrs. after Inoc. | 10,400 | 7.81 | 0 | 3,400 | 7.97 | 33 |
| 22.5 hrs. after Inoc. | 9,900 | 7.75 | 0 | 3,800 | 7.94 | 33 |

*Inoculation

These cultures were then used to treat burley tobacco lamina with the following results:

| Treatment Time (hrs.) | Aerated Inoculum From Fermentor A: Wet Tobacco pH | $NO_3$ (%) | Unaerated Inoculum From Fermentor B: Wet Tobacco pH | $NO_3$ (%) |
|---|---|---|---|---|
| Inoculated Tobacco[1] | | | | |
| 0 | 7.11 | 3.27 | 7.52 | 3.41 |
| 24 | 8.27 | 0.57 | 8.13 | 1.30 |
| Uninoculated Control[2] | | | | |
| 0 | 7.17 | 3.14 | 7.20 | 2.85 |
| 24 | 7.60 | 3.32 | 7.49 | 2.90 |

[1]All treatments were:
90 gm dry weight burley lamina
20 ml 1N NaOH
116 ml $H_2O$
134 ml Inoculum
30° C. in plastic bags with restricted air availability
[2]All controls were:
90 gm dry weight burley lamina
20 ml 1N NaOH
250 ml $H_2O$
No Inoculum
30° C. in plastic bags with restricted air availability It can be seen that the aerated culture produced the greatest cell mass and degraded the leaf tobacco nitrate best. However, the unaerated culture also produced a large amount of degradation of the leaf tobacco nitrate. Tobacco treated with cultures grown under either set of conditions is acceptable for use in tobacco products.

EXAMPLE 4

This example demonstrates nitrate degradation of an inoculated tobacco.

Five pounds of burley tobacco were treated with an aerated culture of *Micrococcus denitrificans* (ATCC 17741) grown for 22 hours as described in Example 3. The treated tobacco was bulked at 30° C. in a plastic bag using the following materials:

Inoculum (ml)—2880
Tobacco Weight (gm)—2270
1N NaOH (ml)—449.5
Tap Water (ml)—2572

The results of this treatment were:

| Treatment Time (hrs.) | Wet Tobacco pH | $NO_3$ (%) |
|---|---|---|
| Inoculated Tobacco (2270 gm tob. wt.) | | |
| 0 | 6.98 | 2.95 |
| 18 | 7.44 | 1.82 |
| 21 | 7.58 | 1.44 |
| Uninoculated Control (90 gm tob. wt.) | | |
| 0 | 7.14 | 2.78 |
| 21 | 7.24 | 3.21 |

It can be seen that the nitrate content of the treated tobacco was reduced from 2.95% to 1.44% (a 51% reduction) while the nitrate content of the control sample did not decrease.

EXAMPLE 5

This example demonstrates the reduction of nitrogen oxides (NOx) and hydrogen cyanide (HCN) in smoke from a tobacco product when using a tobacco which has been subjected to nitrate degradation by the microorganism *Micrococcus denitrificans.*

Nine hundred eight grams of burley tobacco lamina was mixed with 2,864 ml of *Micrococcus denitrificans* grown in flue-cured/burley stem extract as described in Example 1. No additional water was added and no pH adjustment was made prior to inoculation. The tobacco was thoroughly mixed and placed into a plastic bag and incubated at 30° C. for 24 hours.

| Treatment Time (hrs.) | Nitrate (%) | pH | Moisture (%) |
|---|---|---|---|
| 0 | 2.13 | 7.25 | ~75 |
| 18 | 1.57 | — | — |
| 24 | 0.91 | 7.95 | ~75 |

In this tobacco treatment the liquid inoculum served three purposes:

(1) Initial tobacco pH adjustment (pH at ~5.8 starting).
(2) Tobacco moisture elevation (target 75%).
(3) Supply culture to degrade nitrate.

After microbial treatment, the burley tobaccos were mixed with other standard blend components where the total blend nitrate content was 1.16% compared to 1.69% for the untreated control blend.

The separate blends were made into cigarettes and smoked on a constant vacuum smoking machine. The results were:

| Sample | Blend Nitrate (%) | Per Puff Deliveries NOx (μg) | HCN (μg) | Puff No. |
|---|---|---|---|---|
| Untreated Control | 1.69 | 40 | 13.5 | 7.2 |
| Treated | 1.16 | 33 | 11.8 | 7.3 |

It can be seen that the nitrogen oxides in smoke are significantly reduced (17.5%) in the sample containing the treated tobacco. Also, the hydrogen cyanide delivery is reduced (12.6%) in the sample containing treated tobacco. All other delivery components remained virtually unchanged.

EXAMPLE 6

This example demonstrates the reduction of nitrogen oxides (NOx) and hydrogen cyanide (HCN) in a tobacco product when using a tobacco which has been subjected to nitrate degradation by the microorganism *Micrococcus denitrificans.*

*Micrococcus denitrificans* (ATCC No. 17741) was grown as described in Example 3 (Fermentor "A" conditions) and used to treat burley tobacco for 24 hours in closed plastic bags at 30° C. The nitrate in the growth medium was depleted at 17 hours.

The following amounts of materials were used:

Inoculum (ml)—1716
1N NaOH (ml)—270
Water (ml)—1555
Tobacco (gm)—1362

Tobacco treatment results were:

| Treatment Time (hrs) | Wet Tobacco pH | $NO_3$ (%) | Moisture (%) |
|---|---|---|---|
| Inoculated Tobacco | | | |
| 0 | 7.21 | 2.51 | 75.7 |
| 21 | 7.70 | 1.33 | 73.9 |
| 24 | — | 1.33 | — |
| Air Dried | 8.28 | 1.41 | — |

After treatment, the burley lamina was blended with other tobacco components and made into cigarettes and smoked on a constant vacuum smoking machine. A control product, without treated lamina, but incorporating untreated burley lamina, was also machine smoked. The results were:

| Sample | Blend Nitrate (%) | Per Puff Deliveries NOx (μg) | HCN (μg) | Puff No. |
|---|---|---|---|---|
| Control | 1.70 | 61 | 33 | 7.04 |
| Experimental | 1.36 | 49 | 30 | 7.08 |

It can be seen from the above data that nitrogen oxides were significantly reduced (19.7%) in the product containing the treated tobacco. Also, the hydrogen cyanide delivery was reduced (9.1%) in the product containing treated tobacco.

EXAMPLE 7

This example demonstrates the procedure of extracting tobacco lamina with water to remove nitrate, treating the extract with *Micrococcus denitrificans* (ATCC No. 17741) to remove the nitrate therefrom, then adding the modified extract back to the original tobacco.

A tobacco extract was prepared by mixing 100 gms of burley lamina with one liter of water and allowing it to stand at room conditions for two hours. At this point, the extract was collected by decanting the liquid and pressing the tobacco to remove additional liquid. The tobacco was spread to dry in room air while the extract (~700 ml) was subjected to microbial treatment.

A mature culture of *Micrococcus denitrificans* was grown in flue-cured/burley stem extract medium, prepared as described in Example 1, and added to the tobacco extract, prepared as described in the previous paragraph, at a 10% (v/v) rate. Prior to culture addition, the extract pH was raised to 7.0±0.1. The culture was incubated in the extract in an Erlenmeyer flask on a rotary shaker at 30° C. The following chemical changes occurred across the 18 hour incubation time:

| *Micrococcus denitrificans* Treatment of Burley Lamina Extract | $NO_3$ (μg/ml) |
|---|---|
| Burley lamina extract | 1872 |
| Mature *Micrococcus denitrificans* culture | 64 |
| Extract after treatment (18 hrs) | 66 |

The data indicate that nitrate was almost completely degraded (~96%) by the treatment.

After the 18 hours incubation, the treated extract was added back to the originally extracted tobacco in three stages because of the large volume of treated extract. This was done by adding a portion, mixing thoroughly and air drying, prior to the next addition. The following chemical changes resulted from this procedure:

| Tobacco Analysis | $NO_3$ (%) |
|---|---|
| Burley lamina before extraction | 1.96 |
| Burley lamina after extraction | 0.72 |
| Burley lamina after treated extract added back | 0.44 |

Data show that 77% of the nitrate was removed by the *Micrococcus denitrificans* treatment.

The tobaccos resulting from this operation were useable in manufacturing type operations.

In certain reconstituted tobacco manufacturing processes, the step of extracting the tobacco solubles is an integral part of the overall processing. If preferred, the resultant extracted tobacco could be processed by paper-making techniques into base sheet to which the extract, from which nitrate has been recovered by microbial treatment, could then be added back in the normal manner.

EXAMPLE 8

This example demonstrates some differences in the final product which can be obtained by using ultrafiltration equipment in conjunction with tobacco extraction, extract treatment and extract addback as described in Example 7. Tobacco used in this work was from the same source as that used in Example 7.

cured/burley stem extract (with 0.5% yeast extract added and prepared as in Example 1) was used for standard extract. Broth pH was adjusted prior to inoculating the standard ("control") extract and the experimental extract with *Micrococcus denitrificans.*

The following results were obtained:

| Growth Time (hrs) | $NO_3$ (μg/ml) | pH |
|---|---|---|
| STANDARD EXTRACT | | |
| 0 | 1,896 | 7.37 |
| 24 | 0 | 8.07 |
| EXPERIMENTAL EXTRACT | | |
| 0 | 2.220 | 7.31 |
| 24 | 2,256 | 6.95 |
| 48 | 227 | 7.95 |

It can be seen that this data illustrates that the culture can effectively degrade the nitrate of an extract of reconstituted tobaccos.

EXAMPLE 11

This example demonstrates the effects of aerobic and anaerobic tobacco treatments.

Micrococcus dentrificans (ATCC No. 17741) was grown in flue-cured/burley stem extract broth with 0.5% yeast extract added for 24 hours in a New Brunswick Scientific Fermentor (MF 214) under the following conditions:

| Parameters | |
|---|---|
| Agitation (rpm) | 300 |
| Aeration (cc/min.) | 0 |
| Medium Flue-cured/Burley Stem Extract | +0.5% YE |
| Medium Vol. (liters) | 8 |
| Temperature (°C.) | 30 |
| pH starting (uncontrolled) | 7.8 |
| Inoc. Rate (%) | 5 |
| Inoc. Age (hrs) | 24 |
| Antifoam (Dow/Chemical) | P-1200 |

The culture at initiation and at 24 hours was characterized by:

| Time (hrs) | $NO_3$ (μg/ml) | pH |
|---|---|---|
| 0 | 2169 | 7.74 |
| 24 | 52 | 8.20 |

At 24 hours, the culture was used to treat burley tobacco under aerobic and anaerobic conditions with the following results:

| | Time (hrs) | | | |
|---|---|---|---|---|
| | 0 | | 24 | |
| | pH | (%) $NO_3$ | pH | (%) $NO_3$ |
| Aerobic Treatments | | | | |
| Control | 7.20 | 3.39 | 7.41 | 3.27 |
| Treatment | 7.59 | 3.39 | 7.92 | 1.81 |
| Anaerobic Treatments | | | | |
| Control | 6.93 | 3.39 | 7.03 | 3.79 |
| Treatment | 7.49 | 3.39 | 7.65 | 1.61 |

All tobaccos were at ~75% moisture content and were stored at 30° C. for 24 hours in plastic bags. Anaerobic treatments were conducted in BBL (Baltimore Biological Laboratories) "Gaspak" anaerobic system jars using BBL catalyst to tie up atmospheric oxygen.

It is seen from the above data that the present invention can be carried out under anaerobic conditions and under conditions when availability of oxygen is not controlled.

EXAMPLE 12

This example demonstrates the effect of treating tobacco with cells as well as supernatant liquor from the cell growth.

*Micrococcus denitrificans* (ATCC No. 17741) was grown in flasks of flue-cured/burley stem extract broth, with 0.5% (wt/vol) yeast extract added, prepared as in Example 1(c). Flask inoculation and incubation were conducted as described in Example 1(d). At the end of the growth period, the culture was processed as shown in FIG. 1.

FIG. 1

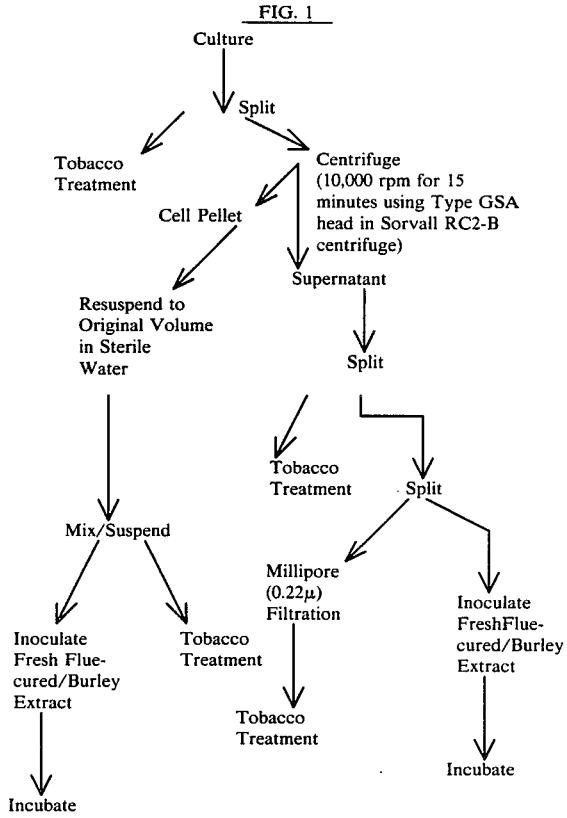

The following resulted from the operations shown in the Figure.

TABLE

CULTURE PREPARATION FLUE-CURED/BURLEY EXTRACT BROTH WITH 0.5% YE

| | Time (hrs) | $NO_3$ (μg/ml) | pH |
|---|---|---|---|
| Control | 0 | 1618 | 7.13 |
| (Uninoculated) | 24 | 1550 | 7.04 |
| Inoculated | 0 | 1575 | 7.20 |
| | 24 | 36 | 8.02 |
| Resuspended cells | | 0 | 8.18 |
| Supernatant | | 34 | 8.15 |
| Filtered Supernatant | | 36 | 8.26 |

A burley lamina extract was prepared as in Example 7. The extract was then filtered with a 0.2 micron pore size filter in an Amicon ultrafiltration device (Model TCF10) prior to inoculating the filtered extract with *Micrococcus denitrificans* (ATCC No. 17741) and treating it as described in Example 7. Following treatment, the extract was again filtered (0.2 micron pore size filter) before addback procedures were started. The materials retained on the filter during the first filtration and the permeate from the second filtration were added back to the extracted tobacco.

The materials retained by the filter during the second filtration were not added back to the tobacco. The following chemical changes occurred in the extract:

| Chemical Changes Across Ultrafiltration and *Micrococcus denitrificans* Treatment of Burley Tobacco | $NO_3$ (μg/ml) |
|---|---|
| Burley lamina extract | 1872 |
| Mature *Micrococcus denitrificans* culture | 64 |
| Extract after filtration | 2028 |
| Extract after *Micrococcus denitrificans* treatment | 646 |

The following chemical changes were measured in the tobacco across extraction and treatment:

| Tobacco Analysis Burley Lamina | $NO_3$ (%) |
|---|---|
| Before extraction | 1.96 |
| After extraction | 0.72 |
| After treated extract added back | 0.85 |

These results show that nitrate is removed from the extract by *Micrococcus denitrificans,* but as opposed to Example 7, no further removal from the extracted tobacco occurs during addback procedures. In this example, the microbial cells do not contact the tobacco, whereas in Example 7, the cells do contact the tobacco during addback and produce further chemical changes.

The tobaccos resulting from this operation were useable in manufacturing type operations.

Other filters (with other pore sizes) can be used in the first filtration step (in Examples 7 and 8) to keep many of the larger extracted molecules from being exposed to potential microbial action. If used, the resulting extract would be less modified and a less modified tobacco would result.

EXAMPLE 9

This example demonstrates the ability of *Micrococcus denitrificans* (ATCC Accession No. 19367) to degrade nitrates in tobacco.

*Micrococcus denitrificans* (ATCC Accession No. 19367) was grown in flue-cured/burley stem extract broth (+0.5% YE) prepared as in Example 1. Control and experimental culture broths were pH adjusted to ~7.2 prior to use with 2.4 ml of 1N NaOH/flask. All flasks were incubated at 30° C. and 160 rpm for 24 hours. Those flasks used for cell growth were inoculated at 2% (v/v) rate with *Micrococcus denitrificans* (ATCC No. 19367).

The accompanying table illustrates the nitrate degradation by this culture.

| SET I Time (hrs) | pH | $NO_3$ (μg/ml) |
|---|---|---|
| Control Broth (Uninoculated) | | |
| 0 | 7.28 | 2,251 |
| 6 | 7.19 | 2,281 |
| 24 | 7.18 | 2,025 |
| Experimental Broth (Inoculated) | | |
| 0 | 7.19 | 1,975 |
| 6 | 7.10 | 2,031 |
| 24 | 8.18 | 51 |

*Micrococcus denitrificans* was grown in the same broth as shown above and chemical analyses were performed at a different intermediate time interval with the following results:

| SET 2 Time (hrs) | pH | $NO_3$ (μg/ml) |
|---|---|---|
| Control Broth (Uninoculated) | | |
| 0 | 7.28 | 2,251 |
| 6 | 7.19 | 2,281 |
| 24 | 7.18 | 2,025 |
| Experimental Broth (Inoculated) | | |
| 0 | 7.22 | 2,226 |
| 18 | 7.92 | 1,605 |
| 24 | 8.17 | 0 |

The experimental cultures from Sets 1 and 2 were used to treat burley lamina for 24 hours at 30° C. in plastic bags as follows:

| | Materials for Treatment | | | |
|---|---|---|---|---|
| | Tobacco (gm) | 1N $NH_4OH$ (ml) | Water (ml) | Inoculum (ml) |
| Treated | 50 | 10.3 | 69.5 | 70.2 |
| Control | 50 | 10.3 | 139.7 | 0 |

| | Treatment Time | pH | $NO_3$ (%) |
|---|---|---|---|
| Set 1 | 0 hrs. | 7.34 | 2.91 |
| Treated | 24 hrs. | 7.28 | 1.07 |
| Control | 0 hrs. | 7.48 | 2.87 |
| | 24 hrs. | 7.09 | 2.58 |
| Set 2 | 0 hrs. | 7.49 | 3.10 |
| Treated | 24 hrs. | 7.43 | 1.86 |
| Control | 0 hrs. | 7.43 | 3.32 |
| | 24 hrs. | 7.04 | 3.61 |

It can be seen that *Micrococcus denitrificans* (ATCC No. 19367) degraded up to 63% of the nitrate in burley lamina while the control tobacco showed little decrease in nitrate.

EXAMPLE 10

This example demonstrates the effectiveness of *Micrococcus denitrificans* (ATCC Accession No. 17741) in removing nitrate from an extract of a reconstituted tobacco mixture.

A water extract was prepared as follows:

150 g of reconstituted tobacco was pulped in one liter of water for about one minute in a Waring blender. The mixture was held at room temperature for 10 minutes after which the liquid was centrifugally separated and brought back to original volume for sterilization at 121° C. and 15 psig for 15 minutes. Yeast extract (YE) was added at 0.5% (wt/v) rate prior to sterilization. Flue- Resuspended cells and filtered supernatant were used to inoculate separate fresh flasks of flue-cured/burley extract broth at 10 ml/flask (250 ml extract/500 ml flask) and incubated at 30° C. for 24 hours at 160 rpm. Extract was prepared as in Example 1. The following was obtained:

TABLE 2

| | Time (hrs) | $NO_3$ (μg/ml) | pH |
|---|---|---|---|
| Resuspended cells | 0 | 1530 | 7.00 |
| | 24 | 0 | 8.11 |
| Filtered supernatant | 0 | 1576 | 7.11 |
| | 24 | 1464 | 6.99 |

Resuspended cells, original culture, filtered supernatant and unfiltered supernatant were all used separately to treat 50 gm samples of flue-cured/burley stem at about 75% moisture for 24 hours at 30° C. in plastic bags. A control sample was pH adjusted and water treated without inoculum.

TABLE 3

MATERIALS ADDED FOR TOBACCO TREATMENTS

| Tobacco Treated By: | Sterile Distilled Water (ml) | 1N NaOH Base (ml) | Inoculum (ml) |
|---|---|---|---|
| Control (none) | 140.2 | 9.8 | none |
| Original Culture | 96.1 | 9.8 | 44.1 |
| Resuspended cells | 96.1 | 9.8 | 44.1 |
| Supernatant | 96.1 | 9.8 | 44.1 |
| Filtered Supernatant | 96.1 | 9.8 | 44.1 |

The following results were obtained from these tobacco treatments (Table 4).

TABLE 4

TOBACCO TREATMENTS

| | Time (hrs) | $NO_3$ (%) | pH |
|---|---|---|---|
| Control (no inoculum) | 0 | 4.57 | 6.97 |
| | 24 | 4.65 | 7.09 |
| Original culture | 0 | 4.41 | 7.18 |
| | 24 | 2.86 | 7.59 |
| Resuspended cells | 0 | 4.52 | 7.01 |
| | 24 | 0.94 | 7.65 |
| Supernatant | 0 | 4.45 | 7.27 |
| | 24 | 4.38 | 7.13 |
| Filtered supernatant | 0 | 4.41 | 7.07 |
| | 24 | 4.48 | 7.15 |

It can be seen from the above data that the supernatant liquor in which the culture is grown does not provide sufficient culture for degradation of nitrates in tobacco.

What is claimed:

1. A process of reducing the nitrate content of tobacco comprising:
   (a) contacting a tobacco material with a built up inoculum containing a microorganism which degrades the nitrate content of said tobacco; and
   (b) maintaining said tobacco in contact with said microorganism for an effective period of time at an effective temperature to reduce substantially the nitrate content of said tobacco material.

2. A process of reducing the nitrate content of tobacco comprising:
   (a) contacting a tobacco material with a built up inoculum containing a microorganism which degrades the nitrate content of said tobacco; and
   (b) maintaining said tobacco in contact with said microorganism for up to about 24 hours at an effective temperature to reduce substantially the nitrate content of said tobacco material.

3. A process for reducing the nitrate content of tobacco comprising:
   a. contacting a tobacco material with a built up innoculum containing a microorganism which degrades the nitrate content of said tobacco; and,
   b. maintaining said tobacco in contact with said microorganism for approximately 24 hours at an effective temperature.

4. The process of claim 1 wherein said nitrate compound is selected from the group consisting of potassium nitrate, sodium nitrate, and ammonium nitrate.

5. The process of claim 1 wherein said nitrate compound is in the range of from about 0.1 to 1.0 percent by weight of said aqueous medium.

6. The process of claim 1 wherein said microorganism is *Micrococcus denitrificans.*

7. The process of claim 1 wherein said contacting is carried out at a pH of from about 7.0 to 9.5.

8. The process of claim 1, said aqueous medium being prepared by:
   a. adding at least 0.5 percent by weight nutrient agar to water to form a first solution;
   b. adding from 0.1 to 1.0 percent by weight of a nitrate compound to said first solution;
   c. sterilizing said first solution by subjecting said solution to at least 15 psig at 121° C. or greater for a period of at least 15 minutes to from a sterilized medium;
   d. adding *Micrococcus denitrificans* to the sterilized medium and allowing said *Micrococcus denitrificans* to incubate for a period of from about 3 to 5 days at from about 5° C. to about 37° C.; and,
   e. removing resulting growth from the medium.

9. The process of claim 8 wherein said sterilizing of said first medium is accomplished within a test tube on a slant whereby a slanted surface is provided for growth.

10. The process of claim 8 including the preparation of a tobacco extract broth prepared by:
   a. adding tobacco material to water to form a second solution;
   b. cooking said second solution in a vessel for at least 40 minutes at at least 15 psig at a temperature of at least 121° C.;
   c. adjusting the cooked second solution with water to approximately its original volume;
   d. mixing yeast extract at from about 0.1 to 2.0 percent by weight of extract per volume;
   e. sterilizing said second solution for at least 15 minutes at at least 15 psig at a temperature of at least 121° C.; and
   f. adding the resulting growth from the nutrient agar-nitrate compound to said sterilized second solution.

11. The process of claim 1 wherein said maintaining said tobacco in contact with said microorganism is in the absence of free oxygen.

12. The process of claim 1 wherein said maintaining said tobacco in contact with said microorganism is in the presence of oxygen.

13. A process for reducing the nitrate content of tobacco comprising the steps of:
   (a) mixing tobacco into an aqueous solution;
   (b) removing the tobacco from the aqueous solution whereby a tobacco extract broth is left;
   (c) adding *Micrococcus denitrificans* to the broth;
   (d) incubating the *Micrococcus denitrificans;*

(e) adding the incubated *Micrococcus denitrificans* in said broth to said tobacco.

14. The process of claim 13 wherein said aqueous solution is water.

15. The process of claim 13 including the step of sterilizing said broth after step (b).

16. The process of claim 15 wherein said sterilizing is for at least 15 minutes at a pressure of at least 15 psig at a temperature of at least 121° C.

17. The process of claim 13 including the step of adding yeast extract to said broth prior to adding *Micrococcus denitrificans.*

18. The process of claim 17 wherein said yeast extract is from about 0.1 to 2.0 percent by weight of said broth.

19. The process of claim 13 wherein said incubating includes agitation.

20. The process of claim 13 including the step of adjusting the pH of said broth to from 7.0 to 9.5 prior to adding *Micrococcus denitrificans.*

21. A process for reducing the nitrate content of tobacco comprising the steps of:

(a) mixing tobacco into an aqueous solution;

(b) removing the tobacco from the aqueous solution whereby a tobacco extract broth is left;

(c) passing said tobacco extract broth through a semi-permeable membrane, said membrane having sufficient pore size to hold a first retentate and to allow passage of preselected extract components therethrough to form a first permeate; and, (d) treating said first permeate containing the preselected extract components with *Micrococcus denitrificans* to remove nitrate.

22. The process of claim 21 including the steps of:

(e) passing said first treated permeate through a semi-permeable membrane, said membrane leaving sufficient pore size to hold a second retentate which includes said *Micrococcus denitrificans* and to allow passage of treated extract therethrough, said treated extract being a second permeate;

(f) mixing said second permeate with said first retentate; and, (g) adding said second permeate and first retentate mixture to said tobacco removed in step (b).

* * * * *

UNITED STATES PATENT AND TRADEMARK OFFICE

CERTIFICATE OF CORRECTION

PATENT NO. : 4,556,073

DATED : December 3, 1985

INVENTOR(S) : Lawrence E. Gravely et al.

It is certified that error appears in the above-identified patent and that said Letters Patent is hereby corrected as shown below:

Claim 4, column 14, line 11, change "1" to --3--;

Claim 5, column 14, line 14, change "1" to --3--;

Claim 6, column 14, line 17, change "1" to --3--;

Claim 7, column 14, line 19, change "1" to --3--;

Claim 8, column 14, line 21, change "1" to --3--;

Claim 11, column 14, line 56, change "1" to --3--; and,

Claim 12, column 14, line 59, change "1" to --3--.

Signed and Sealed this

*Twelfth* Day of *August 1986*

[SEAL]

*Attest:*

*Attesting Officer*

DONALD J. QUIGG

*Commissioner of Patents and Trademarks*